US007301480B2

(12) United States Patent
Fitzgibbon

(10) Patent No.: US 7,301,480 B2
(45) **Date of Patent: *Nov. 27, 2007**

(54) SYSTEM AND METHOD FOR PRIORITIZING SENSORS IN A BARRIER OPERATOR SYSTEM

(75) Inventor: James J. Fitzgibbon, Batavia, IL (US)

(73) Assignee: Chamberlain Group, Inc., Elmhurst, IL (US)

( * ) Notice: Subject to any disclaimer, the term of this patent is extended or adjusted under 35 U.S.C. 154(b) by 168 days.

This patent is subject to a terminal disclaimer.

(21) Appl. No.: 11/139,842

(22) Filed: May 27, 2005

(65) Prior Publication Data

US 2006/0267800 A1 Nov. 30, 2006

(51) Int. Cl.
*G08G 1/01* (2006.01)

(52) U.S. Cl. ..... 340/933; 340/5.23; 340/5.7; 340/5.71; 340/10.1

(58) Field of Classification Search ..... 340/933, 340/938, 5.23, 539.1, 686.1, 435, 436, 5.61, 340/5.7, 5.6, 545.1, 5.71, 10.1; 49/26, 142
See application file for complete search history.

(56) References Cited

U.S. PATENT DOCUMENTS 5,412,297 A * 5/1995 Clark et al. ..... 318/468
6,903,650 B2 * 6/2005 Murray ..... 340/5.23
6,945,303 B2 * 9/2005 Weik, III ..... 160/188

* cited by examiner

*Primary Examiner*—Davetta W. Goins
(74) *Attorney, Agent, or Firm*—Fitch, Even, Tabin & Flannery

(57) ABSTRACT

In a barrier movement operator comprising a controller hard-wire connected to a first safety sensor, it is determined whether a second safety sensor has been wirelessly connected to the controller. When it is determined that the second safety sensor has been wirelessly connected to the controller, the operator is operated according to a first predetermined procedure. On the other hand, when it is determined that the second safety sensor has not been wirelessly connected to the controller, the operator is operated according to a second predetermined procedure.

21 Claims, 3 Drawing Sheets

SYSTEM AND METHOD FOR PRIORITIZING SENSORS IN A BARRIER OPERATOR SYSTEM

FIELD OF THE INVENTION

The field of the invention relates to moveable barrier operators and, more specifically, to prioritizing sensor readings in barrier operator systems.

BACKGROUND

Different types of moveable barrier operators have been sold over the years and these systems have been used to actuate various types of moveable barriers. For example, garage door operators have been used to move garage doors and gate operators have been used to open and close gates.

Such barrier movement operators may include a wall control unit, which is connected to send signals to a head unit thereby causing the head unit to open and close the barrier. In addition, these operators often include a receiver unit at the head unit to receive wireless transmissions from a hand-held code transmitter or from a keypad transmitter, which may be affixed to the outside of the area closed by the barrier or other structure.

Movable barrier operator systems often include external safety sensors. These safety sensors are used to detect obstructions in the path of travel of the barrier. Thus, injury to users and damage to vehicles can be avoided by the use of safety sensors. Previous systems are programmed to react differently when the safety sensors are not attached. In some of these systems, the sensors must be detected by the operator before travel of the barrier is allowed.

Both wired and wireless sensors have been used in previous barrier systems. Wired systems include a hard-wire link between the sensor and the operator while wireless sensors transmit a signal over the air that is received by the operator. Many systems initially include a wired sensor, but not a wireless sensor. If a user desires to add a wireless sensor to the system at a later time, the system must be manually reconfigured to allow for the use of the wireless sensor. This is often done by physically adding or removing a wired connection or jumper at the operator. However, the manual reconfiguration is inconvenient for a user to perform and sometimes requires detailed knowledge of the operator and the configuration steps that a causal user may not possess. In addition, even when users do possess the knowledge, mistakes can be made resulting in damage to the system and additional costs.

SUMMARY

A system and method are provided that determine whether a wireless safety sensor is connected to a moveable barrier operator and, after this determination has been made, operates the operator according to a first predetermined procedure. Otherwise, the operator is run according to a second predetermined procedure. The approaches described herein do not require the manual reconfiguration of the operator by a user when a wireless sensor is added. Consequently, user convenience is enhanced and the potential for reprogramming errors is reduced or eliminated.

In many of these embodiments, a controller in an operator determines whether a second safety sensor has been wirelessly connected to the operator. If it is determined that the second safety sensor has been wirelessly connected to the controller, the operator is operated according to a first predetermined procedure. On the other hand, if it is determined that the second safety sensor has not been wirelessly connected to the controller, the operator is operated according to a second predetermined procedure.

In accordance with the principles described herein, the first predetermined procedure may ignore first signals received from the first safety sensor. In another approach, a high priority ranking may be allocated to second signals received from the second safety sensor and a lower priority ranking may be allocated to first signals received from the first safety sensor.

Advantageously, the first predetermined procedure may include determining a safety action to be performed at the operator using second signals received from the second safety sensor. After the action is determined, it may be performed at the moveable barrier operator. For example, the safety action may include halting the movement of the door or reversing the movement of the door. Other examples of safety actions are possible.

Thus, a system and method are provided that determine whether a wireless safety sensor is connected to a moveable barrier operator. The automatic approaches described herein do not require a user to engage in inconvenient or costly reprogramming of the operator when a wireless sensor is detected. Consequently, user frustration with the system is reduced and the chance for reprogramming errors is reduced or eliminated.

Skilled artisans will appreciate that elements in the figures are illustrated for ease of understanding and have not necessarily been drawn to scale. For example, the dimensions of some of the elements in the figures may be exaggerated relative to other elements to help to improve understanding of various embodiments of the present invention. Also, common but well-understood elements that are useful in a commercially feasible embodiment are often not depicted in order to facilitate a less obstructed view of the various embodiments of the present invention.

DESCRIPTION

Figure 1:
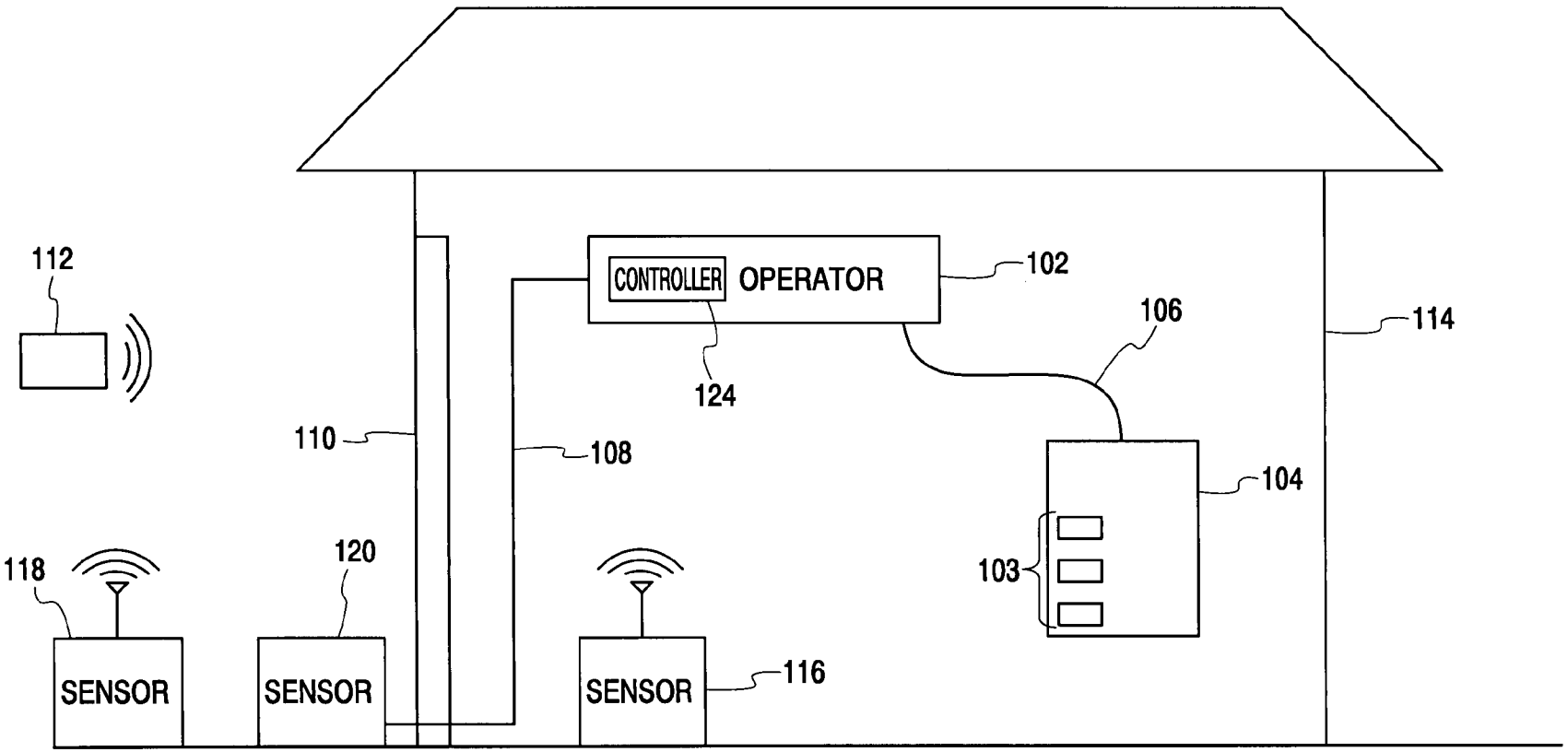
FIG. 1 is a block diagram showing one example of a system for prioritizing sensors according to the present invention.

Referring now to the drawings and especially FIG. 1, a system and method for prioritizing wired sensor data over wireless sensor data is described. An operator 102 is positioned in a garage 114. In this case, the operator 102 is a garage door opener. However, the operator 102 may be any type of moveable barrier operator such as a gate operator or swinging door operator. The operator 102 is used to move the barrier 110, which, in this case is a garage door. However, the barrier 110 may be a garage door, a swinging gate, a sliding gate, a swinging door, shutters, or any other type of barrier. Other examples of barriers and barrier operators are possible.

The operator 102 includes a controller 124. The controller 124 receives signals from wireless sensors 116 and 118, and a handheld transmitter 112. The handheld transmitter 112 transmits coded or uncoded signals that are received at the operator 102 and used to actuate the operator 102. The wireless sensors 116 and 118 are any type of wireless safety sensors. For example, the wireless sensors 116 or 118 may be passive infrared (PIR) detectors or motion sensors. Other examples of wireless sensors are possible.

A wired sensor 120 is also connected to the operator 102 via a wire 108. The wired sensor 120 may be any type of wired safety sensor such as a Passive Infrared (PIR) sensor or a motion sensor. Other examples of wired sensors may also be used.

A wall control unit 106 with buttons 105 is coupled to the operator over link 106. The wall control unit 106 may be used to program the operator 102 or to operate the operator 102. For instance, the buttons 105 may provide functions that allow a user to open and close the barrier 110.

In one example of the operation of the system of FIG. 1, it is determined whether a second wireless safety sensor, such as sensors 116 or 118 has been wirelessly connected to the controller 124 of the operator 102. To be wirelessly connected, one or more parameters can be evaluated. For instance, a signal strength can be used to determine if a wireless sensor is connected. In another example, a frequency or frequency range can be checked to determine if a wireless sensor assigned that range is connected. In still another example, a code transmitted in a signal can be evaluated to determine if the code has been pre-assigned to a wireless sensor. In yet another example, a timing pattern (e.g., duty cycle) of a signal can be evaluated to determine if the wireless sensor is connected. More than one of parameters (e.g., signal strength and frequency) can be evaluated to determine if the wireless sensors are connected. These approaches determine if the wireless sensor is functionally connected to the operator 102 and not merely present near the operator 102. For instance, a weak signal may be detected that indicates the wireless sensor is present but not properly connected to the operator 102.

If it is determined that one or more of the second safety sensors 116 or 118 have been wirelessly connected to the controller, the operator 102 is operated according to a first predetermined procedure. On the other hand, if it is determined that the second safety sensors 116 or 118 have not been wirelessly connected to the controller 124, the operator 102 is operated according to a second predetermined procedure.

The first predetermined procedures may perform a variety of actions and/or processing steps. For instance, the first predetermined procedure may ignore first signals received from the first safety sensor 120. In another approach, a high priority ranking may be allocated to second signals received from the second safety sensors 116 or 118 and a lower priority ranking may be allocated to first signals received from the first safety sensor 120.

Advantageously, the first predetermined procedure may also determine a safety action to be performed at the operator using second signals received from the second safety sensor 116 or 118. After the action is determined, it may be performed at the moveable barrier operator 102. For example, the safety action may include halting the movement of the barrier 110 or reversing the movement of the barrier 110. Other examples of safety actions are possible.

The second predetermined procedure may include receiving signals from the wired sensor 120, processing these signals, and taking appropriate actions. For example, when an object is detected in the barrier 110, the operator 102 may reverse movement of the barrier 110.

Figure 2:
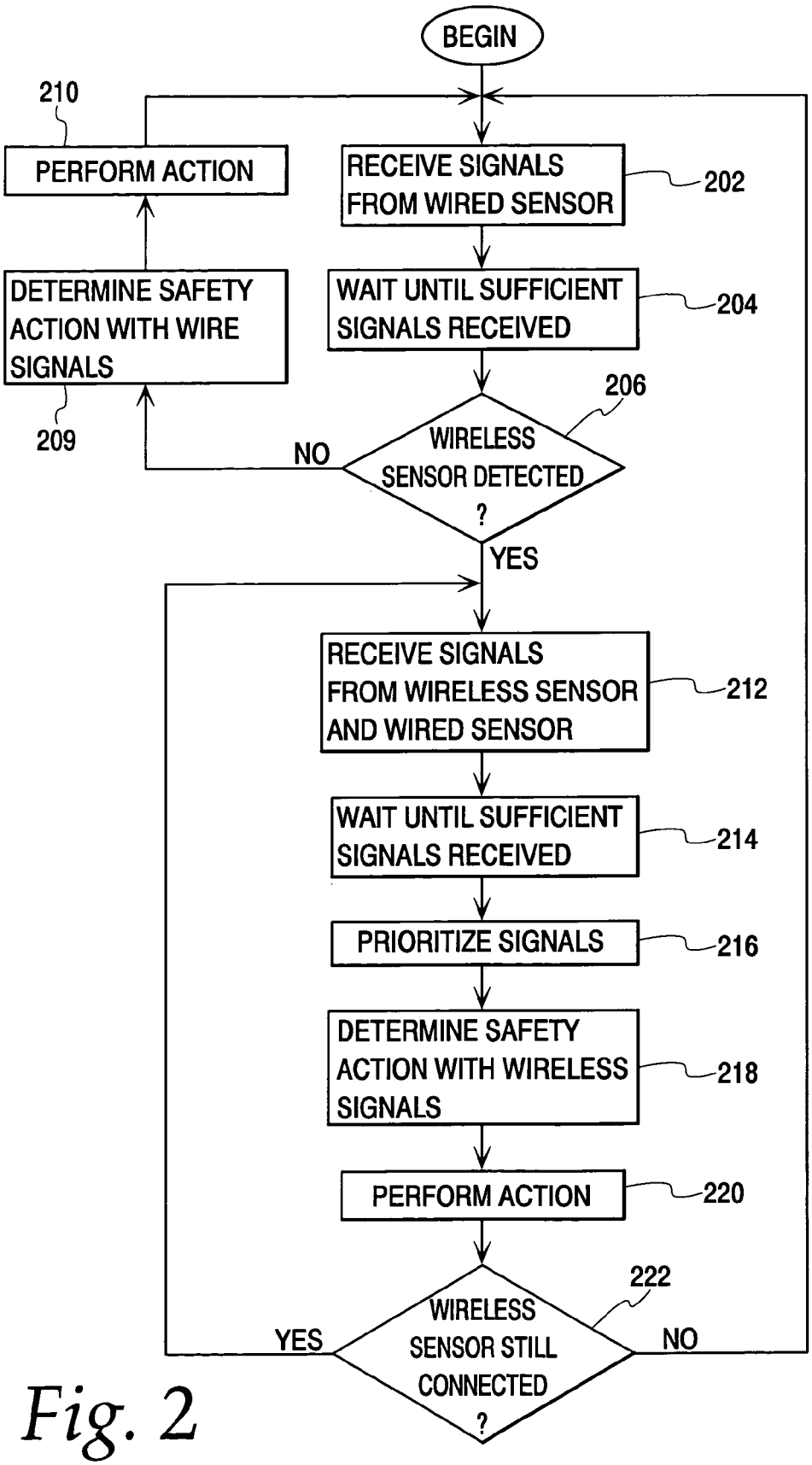
FIG. 2 is a flow chart showing an approach for prioritizing wireless sensor readings over wired sensor readings according to the present invention.

Referring now to FIG. 2, one example of an approach for prioritizing signals received from a wireless sensor is described. At step 202, signals are received from a wired sensor. At step 204, the system waits until a sufficient amount of data has been received so that a message can be interpreted. At step 206, the system determines whether a wireless sensor has been connected. If the answer is affirmative, execution continues at step 212, where a first predetermined procedure is executed (steps 212-222). If the answer is negative, execution continues at step 208 where a second predetermined procedure (steps 208 and 210) is executed.

Turning now to the first procedure, at step 212, the operator receives signals from the wireless sensor. At step 214, the operator waits until sufficient data has been received, for example, in a buffer, so that a message is constituted. At step 216, the operator prioritizes the signals of the wired sensor and the wireless sensor. For example, the operator may determine to ignore and discard all signals from the wired sensor as long as the wireless sensor is connected. In another example, the operator may determine to give a higher priority to signals received from the wireless signal and a lower priority to signals received from the wired sensor, but still use the signals from the wired sensor. Other approaches for prioritizing the signals are possible.

At step 218, a safety action is determined based upon data received from the wireless sensor. At step 220, the action is performed at the operator. For example, the action may include reversing the direction of travel of the barrier once an obstruction is detected. At step 222, a test is made to determine whether the wireless sensor is still connected to the barrier. If the answer is affirmative, then control returns to step 212 as described above. If the answer is negative, then control returns to step 202 where signals are received from the wired sensor.

Turning now to the second procedure, at step 208, the system determines a safety action based upon the signals from the wired sensor. For example, the direction of travel of the door is reversed if the wired sensor detects an obstruction. At step 210, the action is performed. Execution then continues with step 202 as described above.

Figure 3:
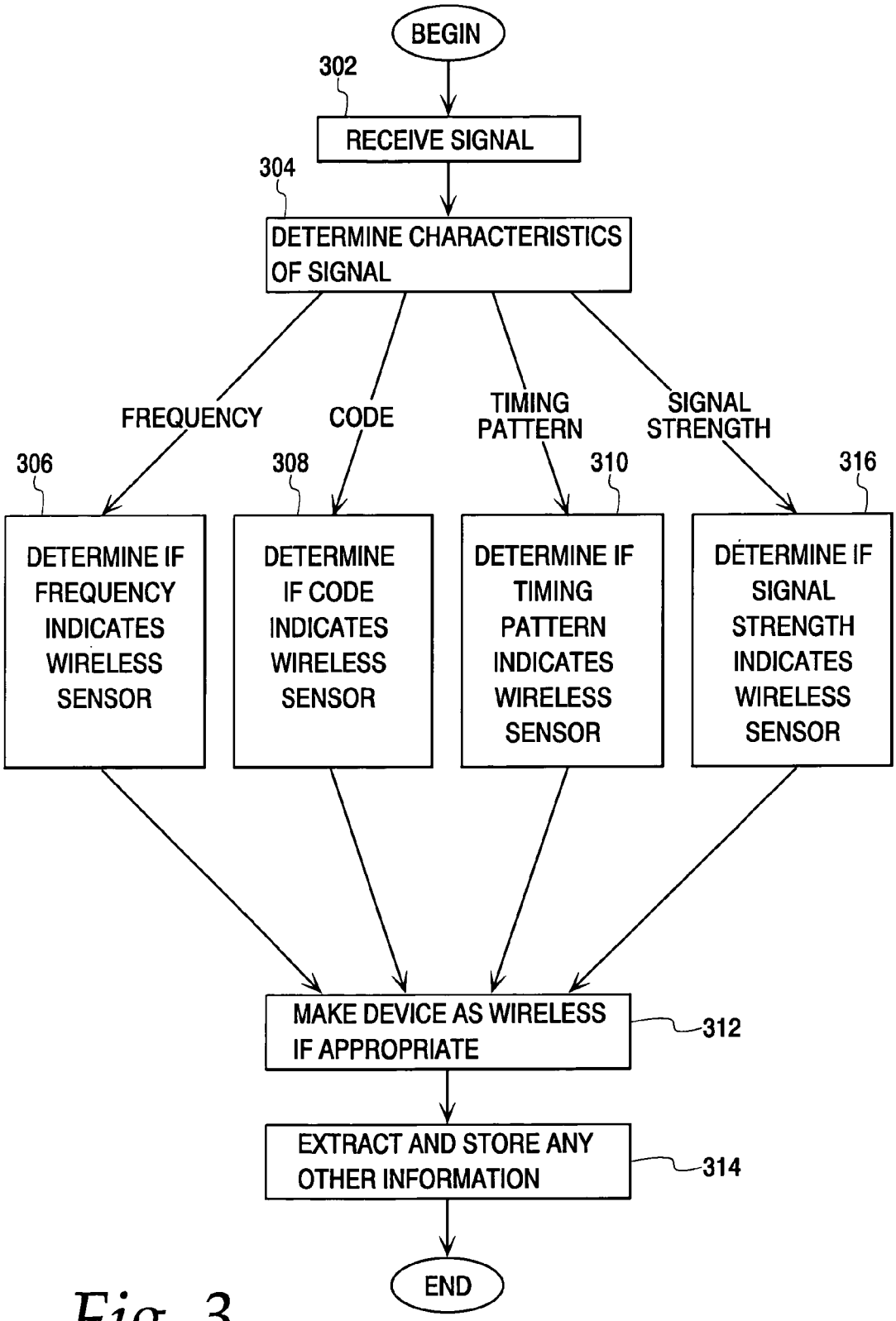
FIG. 3 is a flow chart of an approach for determining when a signal has been sent from a wireless sensor according to the present invention.

Referring now to FIG. 3, one example of an approach for determining whether a wireless sensor is connected to the operator is described. At step 302, a signal is received. At step 304, characteristics of the signal are determined. These characteristics may include the frequency of the signal (e.g., a certain frequency or frequency range indicates the signal originates from a wireless sensor); timing patterns of the signal (e.g., the duty cycle of the signal indicates that the signal originates from a wireless sensor); the informational content of the signal (e.g., the presence of a predefined code indicating the signal originates from a wireless sensor); or the signal strength of the signal. Other characteristics may also be used to determine whether the wireless sensor is connected to the operator.

Based upon which characteristic or characteristics of the signals that are being used to determine the source of the signal, one or more of steps 306, 308, 310, and 316 are executed. Step 306 is executed when frequency is a determining characteristic and, at this step, it is determined whether the frequency of the signal is within a certain range or is of a certain value. If the answer is affirmative (of a certain frequency or with a certain frequency range), then the signal is determined to originate from a wireless sensor and the sensor is deemed to be connected.

Step 308 is executed when the code contained within the signal is a determining characteristic and, with this step, it is determined if a code extracted from the signal matches or is close enough in value codes that are known to originate from wireless sensors. If a code match is determined to exist, then the signal is determined to originate from a wireless sensor and the sensor is deemed to be connected.

Step 310 is executed when the on-off time (i.e., duty cycle) is a determining characteristic. At step 310, it is determined if a particular on-off time is characteristic of a signal known to originate from wireless sensors. If the answer is affirmative, then the signal is determined to originate from a wireless source and the sensor is deemed to be connected.

Step 316 is executed when the signal strength is a determining characteristic. At step 316, it is determined if a particular signal strength is above a predetermined level known to originate from wireless sensors. If the answer is affirmative, then the signal is determined to originate from a wireless source and the sensor is deemed to be connected. This step is preferably performed with others of the steps 306, 308 and 310 and, in this case, is used to verify that the signal is of sufficient strength to perform further processing.

It is possible that only one of the steps 306, 308, 310, and 316 are present and performed. On the other hand, different combinations of the steps 306, 308, 310, and 316 may be used to determine within a high level of certainty whether the signal is from a wireless sensor. In addition, other steps not described herein may also be performed.

In one example of multiple steps being used to determine whether a wireless sensor is connected to the operator, steps 306 and 308 may both be performed. In this case, the system looks at both the frequency and the code contained in the received signal. In some situations the frequency may fall outside a frequency range even though the code indicates that the signal is from a wireless sensor. This may be the result of interference or some other environmental factor. In this example, the system may confirm that the signal is from a wireless source even though it lies outside of the frequency range because the code match is obtained. In this case, the sensor is deemed connected.

In another example, step 316 may be used to determine if the signal strength meets minimum requirements to process the signal. Then, steps 306 and 308 may be used as described above to confirm the sensor is connected. Other examples of weighting the various factors are also possible. Furthermore, the approaches describe above can also be used to identify the signal as originating from a wired sensor.

At step 312, if any combination of the steps 306, 308, 310, and 316 have identified that a wireless sensor is connected, a flag or other indicator is set. This flag or indicator may be used by the first operating procedure described elsewhere in this specification to determine if a wireless sensor has been detected. At step 314, any other information needed to be extracted from the signal is obtained. For example, information representing signal strength or a value of the signal may be extracted for later use.

Thus, a system and method is provided that determines whether a wireless safety sensor is connected to a moveable barrier operator and operates according to a first procedure. Otherwise, the operator operates according to a second procedure. The automatic approaches described herein do not require a user to engage in inconvenient reprogramming of the operator when a wireless sensor is detected. Consequently, user frustration with the system is reduced and the chance for reprogramming errors is reduced or eliminated.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

What is claimed is:

1. In a barrier movement operator comprising a controller hard-wire connected to a first safety sensor, a method comprising:

determining whether a second safety sensor has been wirelessly connected to the controller;

when the determining indicates that the second safety sensor has been wirelessly connected to the controller, operating the operator according to a first predetermined procedure; and when the determining indicates that the second safety sensor has not been wirelessly connected to the controller, operating the operator according to a second predetermined procedure.

2. The method of claim 1 wherein operating the operator according to the first predetermined procedure comprises ignoring first signals received from the first safety sensor.

3. The method of claim 1 wherein operating the operator according to the first predetermined procedure comprises allocating a high priority ranking to second signals received from the second safety sensor and a lower priority ranking to first signals received from the first safety sensor.

4. The method of claim 1 wherein operating the operator according to the first predetermined procedure comprises determining a safety action to perform at the operator using second signals received from the second safety sensor.

5. The method of claim 4 comprising performing the safety action at the moveable barrier operator.

6. A moveable barrier operator comprising:

a signal reception apparatus having an input, the input receiving first signals from a first safety sensor that is hard-wired to the apparatus; and a controller coupled to the signal reception apparatus, the controller programmed to determine whether a second safety sensor becomes wirelessly connected to the signal reception apparatus, the controller programmed to execute a first predetermined routine whenever the second sensor is detected and a second programmed routine whenever only the first sensor and not the second sensor is detected.

7. The operator of claim 6 wherein the controller is further programmed to prioritize second signals received from the second safety sensor over the first signals received from the first safety sensor when the second safety sensor becomes wirelessly connected to the operator.

8. The operator of claim 6 wherein the controller is programmed to prioritize second signals over the first signals by ignoring the first signals received from the first safety sensor.

9. The operator of claim 6 wherein the controller is programmed to prioritize second signals over the first signals by allocating a high priority ranking to the second signals received from the second signal and a lower priority ranking to the first signals received from the first safety sensor.

10. The operator of claim 6 wherein the controller is programmed to determine a safety action using information contained in the second signals.

11. The operator of claim 10 wherein the controller is programmed to perform the safety action.

12. The operator of claim 9 wherein the first safety sensor is a presence sensor.

13. The operator of claim 9 wherein the second safety sensor is a motion detector.

14. A system for operating a moveable barrier comprising:

a first safety sensor; and a moveable barrier operator coupled to the first safety sensor using a wired connection, the operator receiving first signals from the first sensor, the operator programmed to determine whether a second safety sensor becomes wirelessly coupled to the moveable barrier operator and to responsively execute a first programmed routine whenever the second safety sensor is detected and to execute a second programmed routine whenever only the first safety sensor is detected and the second safety sensor is not detected.

15. The system of claim 14 wherein the moveable barrier operator is further programmed to prioritize second signals received from the second safety sensor over the first signals received from the first safety sensor when the second safety sensor becomes wirelessly connected to the operator.

16. The system of claim 14 wherein the operator is programmed to prioritize second signals over the first signals by discarding signals received from the first safety sensor.

17. The system of claim 14 wherein the operator is programmed to prioritize second signals over the first signals by allocating a high priority ranking to the second signals received from the second safety sensor and a lower priority ranking to the first signals received from the first safety sensor.

18. The system of claim 14 wherein the operator is programmed to determine a safety action using second signals from the second sensor.

19. The system of claim 18 wherein the operator is programmed to perform the safety action.

20. The system of claim 14 wherein the first safety sensor is a presence sensor.

21. The system of claim 14 wherein the second safety sensor is a motion detector.

* * * * *